United States Patent [19]

Clark

[11] Patent Number: 5,037,291

[45] Date of Patent: Aug. 6, 1991

[54] METHOD AND APPARATUS FOR OPTIMIZING FUEL-TO-AIR RATIO IN THE COMBUSTIBLE GAS SUPPLY OF A RADIANT BURNER

[75] Inventor: Daniel R. Clark, Fayetteville, N.Y.

[73] Assignee: Carrier Corporation, Syracuse, N.Y.

[21] Appl. No.: 557,240

[22] Filed: Jul. 25, 1990

[51] Int. Cl.[5] ..... F23N 3/00

[52] U.S. Cl. ..... 431/12; 431/75; 431/79

[58] Field of Search ..... 431/8, 75, 79, 12

[56] References Cited

U.S. PATENT DOCUMENTS

| | | | |
|---|---|---|---|
| 4,043,742 | 8/1977 | Egan et al. | 431/79 |
| 4,435,149 | 3/1984 | Astheimer | 431/12 |
| 4,533,315 | 8/1985 | Nelson | 431/75 |
| 4,927,350 | 5/1990 | Zabielski | 431/79 |
| 4,934,926 | 6/1990 | Yamazaki | 431/79 |

*Primary Examiner*—Carroll B. Dority

[57] ABSTRACT

A method and apparatus to optimize the proportion of gaseous fuel and air supplied to a radiant burner employed in a heating appliance. With the flow rate of the gaseous fuel supply held constant, the flow rate of the air supply is adjusted to change the relative proportion of air and fuel in the mixture to attain an optimum value for burner combustion, i.e. a value where the proportion of air is slightly greater than the stoichiometric ratio. The invention employs a sensor to measure the intensity of the radiation emitted by the burner while the air supply to the burner is varied. From the measurements obtained, control parameters are derived which are then applied to set the air supply flow rate to a level that results in the optimum proportion of air and fuel in the mixture.

12 Claims, 3 Drawing Sheets

METHOD AND APPARATUS FOR OPTIMIZING FUEL-TO-AIR RATIO IN THE COMBUSTIBLE GAS SUPPLY OF A RADIANT BURNER

BACKGROUND OF THE INVENTION

This invention relates to the control of radiant burners also known as surface combustion, radiant energy or infrared burners, radiant burners are used in various types of heating appliances. More particularly, the invention relates to a method and apparatus for setting and maintaining the proportion of fuel gas to air in the combustible gas mixture supplied to a radiant burner at an optimum value.

Under ideal conditions, a radiant burner would burn with highest thermal efficiency and lowest production of undesirable emissions when the combustible gas supplied to the burner is a stoichiometric mixture of fuel gas and air, i.e. when there is exactly the amount of air supplied to completely oxidize the amount of fuel supplied. Should the ratio of fuel to air increase above the stoichiometric value, or the mixture becomes fuel rich, however, unburned fuel and carbon monoxide will be present in the combustion gases produced by the burner.

Under actual operating conditions, if a radiant burner were to be configured to operate exactly at the stoichiometric ratio, design or manufacturing defects, transient or chronic departures toward the fuel rich condition from the stoichiometric ratio either generally or locally on the burner surface can result in the production of undesirable and hazardous emissions from the burner. It is general design and engineering practice therefore to operate radiant burners with the fuel air mixture containing some amount of excess air, i.e. where the combustible gas is fuel lean or the fuel to air ratio is below the stoichiometric ratio. Operating in an excess air condition helps to assure that all fuel will be burned and no hazardous combustion products formed. The optimum amount of excess air necessary in a given burner installation depends on a number of factors such as the construction and geometry of the burner and its surroundings as well as the type and composition of the fuel to be burned. In general, the typical radiant burner will begin to exhibit undesirable combustion characteristics as excess air decreases to less than about five to ten percent. In such a burner installation, it is common to design for an excess in percentage in the range of 15–30 percent. Operation at excess air percentages greater than within that optimum range results in degradation of burner performance, loss of efficiency or blowout.

While it is possible to directly measure the flow ratio of the fuel gas and air supplies to a burner and to regulate one or both of the flows so as to produce a combustible gas mixture that is optimum, such a detection and control system would be complex and prohibitively expensive in many applications. The designs of some burner applications include pressure switches to detect air flow rate, but such switches are capable only of detecting gross departures from the optimum excess air value and not of regulating the excess air percentage. Still other designs employ sensors which detect the presence and concentration of constituents, such as oxygen, of the flue gases emanating from the burner. Those designs however are subject to sensor fouling and can be unreliable and inaccurate.

What is needed therefore is an economical, accurate and dependable means to automatically ensure that a radiant burner is supplied with a combustible gas that contains the optimum amount of excess air.

SUMMARY OF THE INVENTION

Accordingly, the invention discloses a novel method and apparatus for automatically monitoring the performance of a radiant burner and controlling the ratio of fuel gas to air in the combustible gas supplied to the burner so that the gas mixture is maintained at or near the optimum value of excess air.

It is widely known that radiant burners, when in operation, emit radiation in the upper ultraviolet, visible and near infrared spectrum. The intensity of that radiation varies with the percentage of excess air in the combustible gas supply. The variation is nonlinear, with a peak occurring near the stoichiometric ratio. Since direct measurement of the proportion of fuel gas and air in the combustible gas supplied to burners in heating appliances used in common residential and commercial applications is impractical and prohibitively expensive, the present invention takes advantage of the relationship between burner radiant intensity and the fuel gas to air ratio by using the intensity as an indirect measure of the excess air in the combustible gas supplied to the burner.

In the method and apparatus taught by the invention, measured variations in the intensity of the radiation emitted by the burner brought about by changing the fuel gas to air ratio are used to derive control parameters which are then applied to adjust and maintain the ratio to a value at or near optimum.

The invention is suitable for use with the constant supply fuel gas regulating valves widely used in heating appliances and a controllable variable combustion air supply to the appliance such as a variable speed air induction or forced air fan or blower. The invention may also be used, with appropriate modifications, with fuel gas regulating valves of other than the constant supply type.

The invention uses a sensor sensitive to radiation in the upper ultraviolet, visible or near infrared spectra that has an output that varies with the intensity of received radiation, a control device and a variable speed air supply controller. Upon start-up of an appliance incorporating the invention, the control device allows conditions to stabilize, then varies the speed of the fan or blower, causing a variation in the fuel gas to air ratio in the combustible gas supply. The variation in gas to air ratio results in a change in the intensity of the radiation emitted by the burner. The sensor detects and measures the change in radiation intensity. The control device then applies the measured variations in intensity to derive control parameters. The control parameters are used to set the fan or blower to a speed that results in a fuel gas to air ratio at or near the optimum value of excess air. The control device may also be programmed to perform the set point derivation or calibration routine at periodic intervals, such as daily, during continuous appliance operation as well as upon detection of a transient change in burner radiant intensity indicating a departure from equilibrium conditions, such as might occur because of blockage of the discharge flue of the appliance. The apparatus may also be employed as a safety device by incorporating a shutdown function in the control device which will shut down the burner if the set point derivation process indicates a need for a blower or fan speed more than a predetermined maximum or less than a predetermined minimum value.

The novel features embodied in the invention are pointed out in the claims which form a part of this specification. The drawings and descriptive matter describe in detail the advantages and objects attained by the invention.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
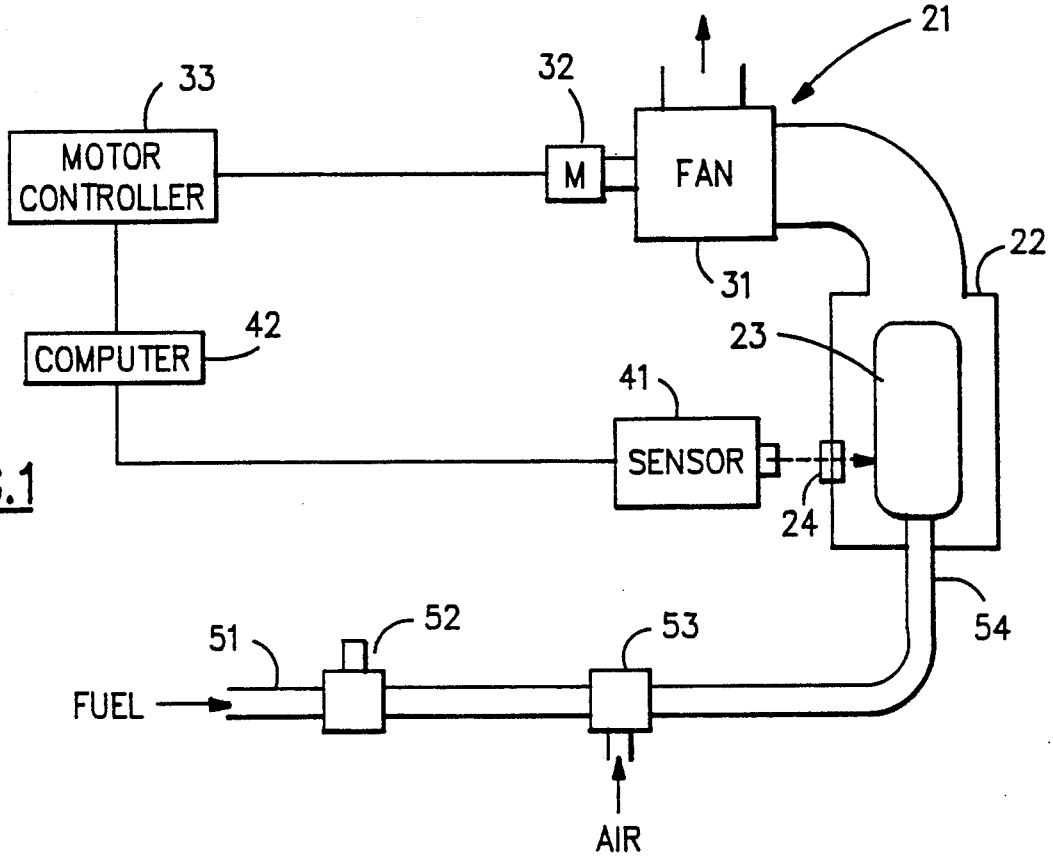
FIG. 1 is a schematic diagram of a heating appliance employing the apparatus taught by the invention.

FIG. 1 illustrates the components and interconnections of the apparatus taught by the invention. In that drawing is shown heating appliance 21, for example a furnace or a water heater, having combustion chamber 22 within which is mounted radiant burner 23. Fuel gas is supplied to the appliance via fuel line 51 and constant flow regulating valve 52. Air is introduced and mixed with the fuel gas in air box 53 to form a combustible gas that then passes to burner 23 via combustible gas line 54. Combustible gas is drawn into and through burner 23 and flue gas containing the products of combustion formed by burner 23 is drawn from combustion chamber 22 by induction fan 31 driven by variable speed motor 32 having motor controller 33. Window 24 in the wall of combustion chamber 22 allows sensor 41 to view the surface of burner 23. Sensor 44 is responsive to radiation in the upper ultraviolet, visible or near infrared spectra and produces an output that varies with the intensity of the radiation emitted by burner 23. The output of sensor 41 is directed to control device 42, having within it a microprocessor, that performs calculations to derive control parameters. The control parameters are used to adjust and maintain the speed of motor 32 through motor controller 33. Because of regulating valve 52, the flow rate of fuel gas is constant. By varying the speed of motor 32 and hence induction fan 31, the total flow rate of combustible gas through burner 23 can be varied. If fuel gas flow rate remains constant, an increase in total flow rate results in an increase in the relative proportion of air in the combustible gas and hence the amount of excess air in the combustible gas can be controlled by controlling the speed of induction fan 31.

Figure 2:
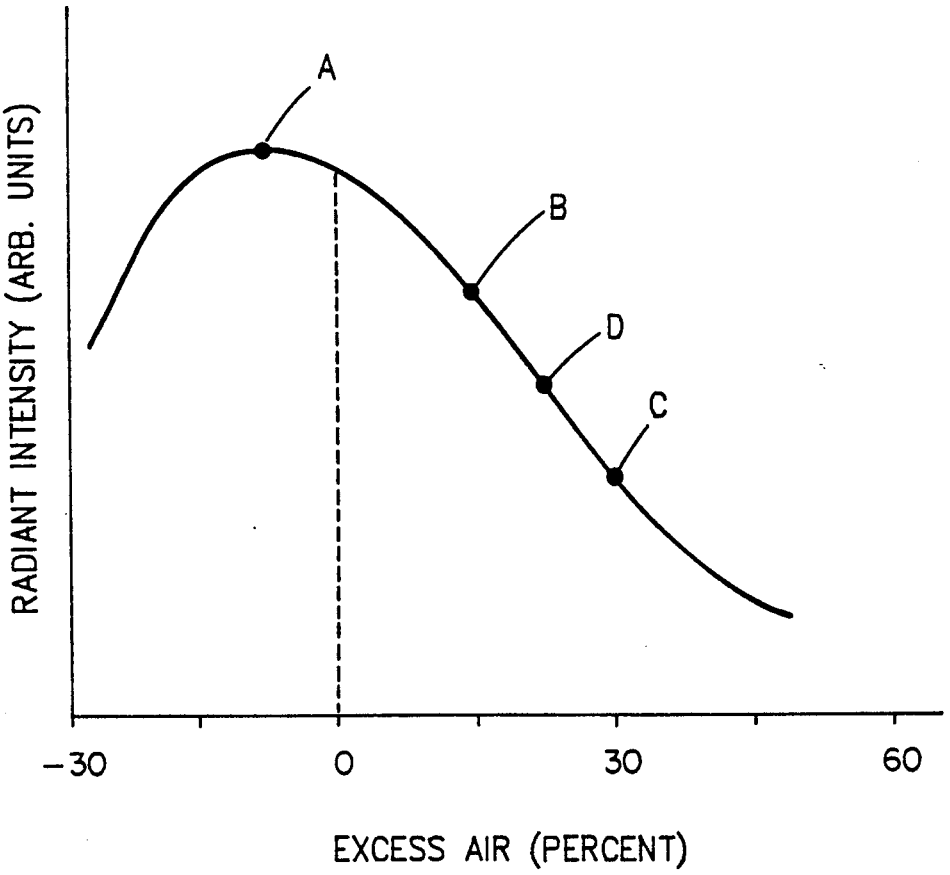
FIG. 2 is a graph of the intensity of radiation emitted by a radiant burner burning a combustible gas comprised of a mixture of methane and air as a function of the fuel gas to air ratio, expressed as a percentage of excess air, in the combustible gas supply.

The curve depicted in FIG. 2 shows the variation in intensity of the radiation emitted by a typical radiant burner as a function of the fuel gas to air ratio, expressed on the graph as a percentage of excess air, in the combustible gas supplied to the burner. The curve of FIG. 2 depicts infrared radiant intensity and is for a combustible gas comprising a mixture of methane and air. A curve of intensity variation for the same burner and fuel supply in the upper ultraviolet and visible portions of the spectrum would be similar. As can be seen from FIG. 2, radiant intensity reaches a peak (at point A in the figure) near the stoichiometric ratio (where excess air percentage is 0). Note that between point B and point C, in the range of 15 to 30 percent excess air, the curve is nearly linear. Point D on the curve denotes the position on the curve where excess air percentage is optimum. Intensity versus excess air curves for burners burning other common gaseous fuels are somewhat different but exhibit similar intensity peaks and near-linearity in a section of the curve on the positive excess air side of the peak.

Figure 3:
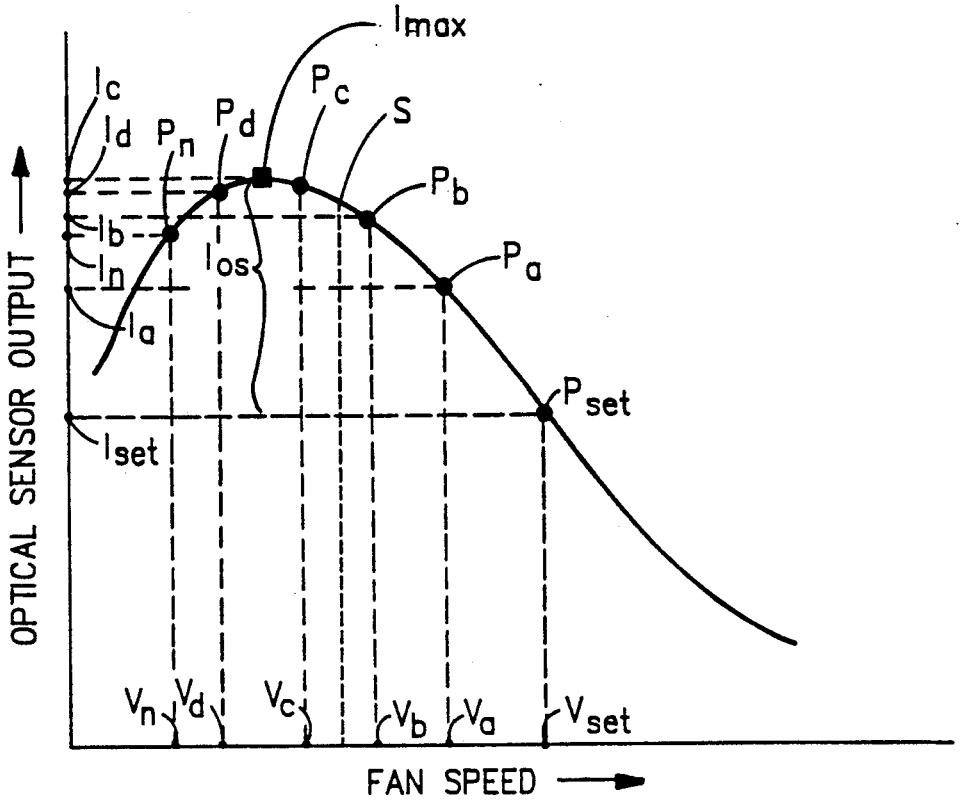
FIG. 3 is a graph of optical sensor output as a function of fan speed upon which is illustrated the method for deriving the control parameter according to one embodiment of the invention.

FIG. 3 illustrates graphically the method, according to one embodiment of the invention, by which a control parameter to attain the optimum amount of excess air is derived in a heating appliance such as is depicted in FIG. 1. The curve shown in FIG. 3 is similar in shape to that depicted in FIG. 2 but shows the output of the sensor, 41 in FIG. 1, typically a voltage, as a function of the speed of the variable speed induction fan, 31 in FIG. 1. The fan speed in such an appliance as is depicted in FIG. 1 and described above determines the amount of excess air in, or the fuel to air ratio of, the combustible gas supplied to the burner. Therefore, as induction fan speed is increased from some low value, the optical sensor output will first increase to a maximum near the stoichiometric ratio S (0 percent excess air) and then decrease with still further increases in fan speed. The method of this embodiment employs the peak in the intensity curve to derive and apply a control parameter to set fan speed to attain an optimum value of excess air. This is accomplished by a calibration routine contained in the program of the control device. In this routine, the control device first causes a step decrease in fan speed. As the fan coasts down, both fan speed and sensor output data points, $V_{a-n}$ and $I_{a-n}$ respectively, are sampled and stored. The control device then restores the fan speed to its initial value. The device then applies a curve fitting algorithm in the program to derive the maximum point, $I_{max}$, on the sensor output versus fan speed curve ("finds the peak") that the measured and stored data points ($P_{a-n}$) define. The device then calculates and stores a set point sensor output, $I_{set}$. This set point sensor output is a predetermined offset, $I_{os}$, such as a fixed percentage, from the calculated maximum intensity value, or peak of the curve, that, when attained, will result in the optimum amount of excess air in the combustible gas, $P_{set}$. The control device then adjusts fan speed to attain the set point sensor output and stores the speed required as a set point fan speed, $V_{set}$. The control device then controls the fan speed so as to maintain the sensor output at its set point value. The stored set point fan speed is also available for use in the next start-up sequence as described below. The entire calibration routine, including the reduction in and restoration of the fan speed, can be accomplished in less than 15 seconds.

Figure 4:
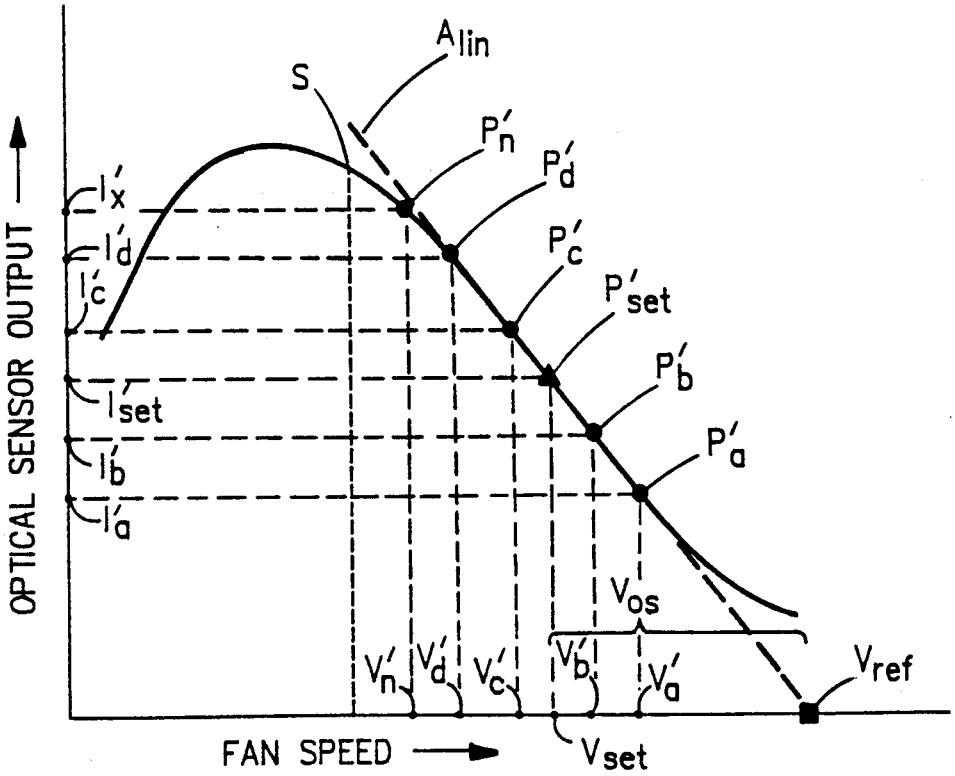
FIG. 4 is a graph of optical sensor output as a function of fan speed upon which is illustrated the method for deriving the control parameter according to another embodiment of the invention.

FIG. 4 illustrates graphically the method, according to another embodiment of the invention, by which the control parameter is derived. In this method, unlike the method depicted in FIG. 3, the calibration routine programmed in the control device employs the near-linear characteristic of that portion of the intensity versus fan speed curve around the optimum excess air value. In this calibration routine, the control device varies fan speed a small amount above and below the initial value while sampling and storing both fan speed and sensor output data points, $V'_{a-n}$ and $I'_{a-n}$ respectively. The control device then returns fan speed to its initial value. The control device then applies an algorithm to calculate both the slope of a best-fit linear approximation $A_{lin}$ to the sensor output curve defined by the data points $P'_{a-n}$ and, by extrapolation, a fan speed reference point, $V_{ref}$, along the linear approximation where the sensor output would reach an arbitrary minimum value, such as zero. The control device then calculates and stores a set point sensor output, $I'_{set}$. This set point output is an offset, based on both the slope of the linear approximation and the fan speed reference point, which, when attained, will result in the optimum amount of excess air in the combustible gas supply. Then, as in the method of the embodiment depicted in FIG. 3, the control device adjusts fan speed to attain the set point sensor output and stores the fan speed required as a set point fan speed, $V'_{set}$, and continues to control fan speed to maintain set point sensor output.

Figure 5:
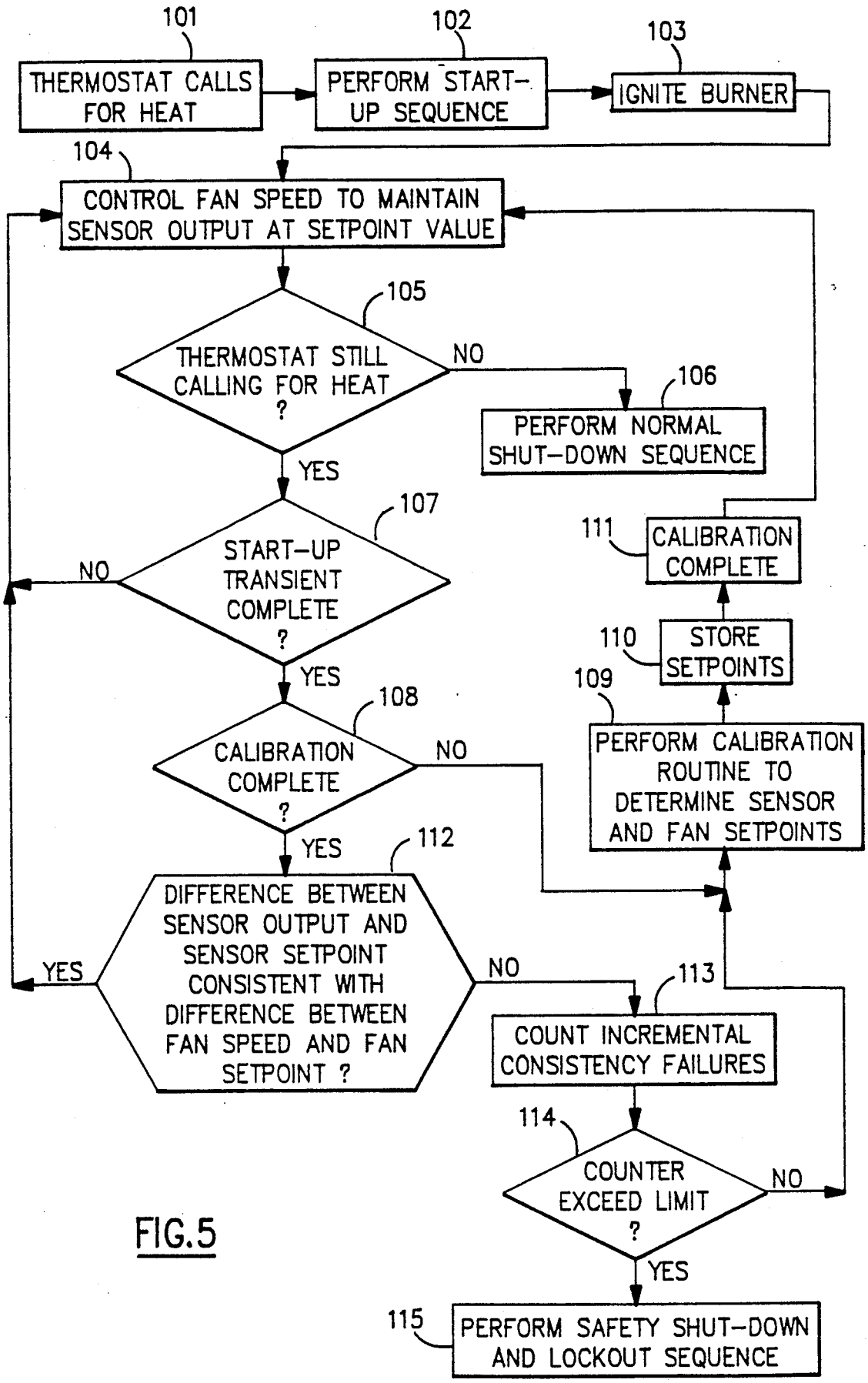
FIG. 5 is a logic diagram illustrating the logic programmed into the control device to derive the control parameter, control excess air and monitor burner performance.

FIG. 5 is a diagram illustrating the logic programmed into the control device to derive the control parameters, control fan speed and monitor burner performance. In addition, the diagram illustrates how the apparatus of the invention can be employed as a safety device.

As indicated in block 101, the process is initiated by the call of an external thermostat for heat. At this time, the appliance enters a start-up sequence, block 102, in which the fan is started and the fan motor controller set to a predetermined initial value. For the initial start-up after installation of the appliance or if there has been a power interruption to the control device, this initial value is a default value contained in the control device program. For start-ups under other conditions, the initial speed is the set point fan speed measured and stored during the last calibration routine. When the fan speed is at the initial value, the gas supply valve is opened and an ignition device ignites the burner, block 103. The sensor senses the intensity of the radiation emitted by the burner and the control device controls the fan speed to cause the sensor output to equal the set point sensor output, block 104. In the same manner as for the initial fan speed, this initial set point sensor output will be a predetermined value, either the set point calculated and stored during the last calibration routine or, if no set point is stored, a default value programmed in the control device.

After the appliance is started up and the control device is controlling fan speed on set point sensor output, the control logic then determines whether the thermostat is still calling for heat, block 105. In the initial cycles through the program logic, the answer will probably be YES and the logic will then determine whether the transient associated with start-up of the appliance is complete, block 107. This function would be typically a simple time delay, Until the delay time has elapsed, the logic at block 107, will determine a NO answer and the logic will cycle back to block 104 to control fan speed to attain a sensor output equal to the set point value. When the delay time has run and assuming that in block 105 the thermostat is still calling for heat, the logic will then receive a YES answer in block 107 and proceed to determine whether a calibration routine has been run, block 108. On start-up of the appliance, the answer will be NO and the control and computation device will then proceed to perform the calibration routine, block 109, according to a method such as is depicted and described by and in conjunction with FIG. 3 or as is depitted and described by and in conjunction with FIG. 4. As discussed above, as part of the calibration routine, the program in the control device will determine an updated set point sensor output and a set point fan speed. Both updated set points will be stored, block 110, for use during the next start-up and initial operation during the next cycle of appliance operation. After completion of the calibration routine, block 111, the control device will continue to control fan speed to maintain the sensor output at the updated set point value and thus maintain the amount of excess air in the combustible gas supply to the radiant burner at the desired value.

At some time during appliance operation and as the control device cycles through its program logic, the thermostat may no longer be calling for heat, block 105. At that time, the device enters the normal shutdown sequence, block 106, and issues signals to shut off the fuel gas supply and shut off the fan until the thermostat next calls for heat.

If the method and apparatus of the invention is employed in an application where the appliance will operate continuously for extended periods, the program logic in the control device can be set to perform a calibration routine at periodic intervals, such as daily, during such extended periods of operation.

The control device also can monitor burner performance and serve as a safety device. After the calibration routine is complete, the logic will receive a YES answer at block 108. Then the logic of the device will measure the difference between actual and set point sensor output and actual and set point fan speed, block 112. Under normal conditions, the program will determine a YES answer at this node and continue to control fan speed to maintain sensor output at the set point value, block 104. Should conditions in the appliance change however, the control device will detect the inconsistency and determine a NO answer. Disregarding blocks 113, 114 and 115 for the moment, the logic will then enter the calibration routine, block 109, and calculate a new sensor set point output and a new fan speed set point and control fan speed to maintain sensor output at the new set point value.

Now considering blocks 113, 114, and 115, and that there is some large deviation from normal operation, such as would be caused by the burner failing to ignite, to become extinguished or by a blockage in the external flue of the appliance, the inconsistency would be so great that even after completing a calibration routine, the control device would still receive a NO at block 111 and enter still another calibration routine in an attempt to achieve consistency. The program logic counts these successive attempts to achieve consistency, block 113, and if the counter exceeds a programmed value, block 114, the control device enters a safety shutdown and lockout sequence, block 115. This sequence is similar to a normal shutdown sequence but includes a lockout function which prevents start-up of the appliance even if the external thermostat calls for heat. The appliance then cannot be restarted until the lockout is manually cleared, preferably after the cause of the safety shutdown has been determined and corrected.

While two preferred embodiments of the present invention are shown and described, those skilled in the art will appreciate that variations such as employing forced rather than induced draft, may be produced which remain within the scope of the invention. The invention may also be used with an appliance having a gas regulating value of other than the constant flow type, in which case suitable provisions be made in the logic of the control device. It is intended, therefore, that the scope of the present invention be limited only by the scope of the below claims.

What is claimed is:

1. In a heating appliance employing a radiant burner that burns a combustible gas comprised of a mixture of gaseous fuel and combustion air and that emits radiation while burning said combustion gas, having means for supplying said gaseous fuel to said radiant burner at at least one flow rate and having means for controlling the rate of supply of said combustion air to said radiant burner, a method of setting the proportion of said gaseous fuel to said combustion air in said combustible gas to a desired proportion comprising the steps of:

setting said gaseous fuel supply means at a given flow rate;

measuring the unmodulated intensity of said radiation;

deriving a control parameter based on measurements of intensity of said radiation taken while varying said combustion air flow rate; and applying said control parameter to said means for controlling the rate of supply of said combustion air so as to reach and maintain a flow rate of said combustion air that results in said desired proportion.

2. The method of claim 1 in which said radiation is in the upper ultraviolet, visible or near infrared spectra.

3. The method of claim 1 in which said control parameter derivation step comprises the substeps of:

varying said combustion air flow rate so that the intensity of said radiation first increases then decreases while simultaneously recording said multiple measurements;

determining from said recorded multiple measurements the value of said combustion air flow rate when the intensity of said radiation is at a maximum; and calculating said control parameters based on said maximum intensity value.

4. The method of claim 3 in which said radiation is in the upper ultraviolet visible or near infrared spectra.

5. The method of claim 1 in which said control parameter derivation step comprises the substeps of:

varying said combustion air flow rate about a rate estimated to be at or near a value that results in said desired proportion while simultaneously recording said multiple measurements;

determining from said recorded multiple measurements the value of said combustion air flow rate when the intensity of said radiation would be at a minimum; and calculating said control parameters based on said minimum intensity value.

6. The method of claim 5 in which said radiation is in the upper ultraviolet, visible or near infrared spectra.

7. In a heating appliance employing a radiant burner that burns a combustible gas comprised of a mixture of gaseous fuel and combustion air and that emits radiation while burning said combustible gas, having means for supplying said gaseous fuel to said radiant burner at at least flow rate and having means for supplying said combustion air at a variable flow rate, an apparatus for setting the proportion of said gaseous fuel to said combustion air in said combustible gas to a desired proportion comprising:

means for setting said gaseous fuel supply means at a given flow rate;

means for measuring the unmodulated intensity of said radiation while varying the rate of supply of combustion air;

means for deriving control parameters from measurements of the intensity of radiation from said burner; and means for applying said control parameters to control said combustion air supply means so as to reach and maintain a combustion air flow rate that results in said desired proportion.

8. The apparatus of claim 7 in which said radiation is in the upper ultraviolet, visible or near infrared spectra.

9. The apparatus of claim 7 in which said intensity measuring means comprises a sensor that responds to said radiation with an output that varies with the intensity of said radiation;

said derivation means and said application means comprise a control device having microprocessor means; and said combustion air supply means comprises an induction fan unit having a variable speed motor and controller.

10. The apparatus of claim 9 in which said radiation is in the upper ultraviolet, visible or near infrared spectra.

11. In a heating appliance employing a radiant burner that burns a combustible gas comprised of a mixture of gaseous fuel and combustion air and that emits radiation while burning said combustible gas, having means for supplying said gaseous fuel to said radiant burner at at least one flow rate and having means for supplying said combustion air at a variable flow rate comprising an induction fan unity having a variable speed motor and controller, an apparatus for setting the proportion of said gaseous fuel to said combustion air in said combustible gas to a desired proportion comprising:

means for setting said gaseous fuel supply means at a given flow rate;

means for measuring the intensity of said radiation while varying the rate of supply of combustion air comprising a sensor that responds to said radiation with an output that varies with the intensity of said radiation;

means for deriving control parameters from measurements of the intensity of radiation from said burner comprising a control device having microprocessor means; and means for applying said control parameters to control said combustion air supply means so as to reach and maintain a combustion air flow rate that results in said desired proportion.

12. The apparatus of claim 9 in which said radiation is in the upper ultraviolet, visible or near infrared spectra.

* * * * *